US007950371B2

(12) United States Patent
Cinpinski et al.

(10) Patent No.: US 7,950,371 B2
(45) Date of Patent: May 31, 2011

(54) FUEL PUMP CONTROL SYSTEM AND METHOD

(75) Inventors: Kenneth J. Cinpinski, Ray, MI (US); Byungho Lee, Ann Arbor, MI (US)

(73) Assignee: GM Global Technology Operations LLC

( * ) Notice: Subject to any disclaimer, the term of this patent is extended or adjusted under 35 U.S.C. 154(b) by 38 days.

(21) Appl. No.: 12/424,175

(22) Filed: Apr. 15, 2009

(65) Prior Publication Data

US 2010/0263630 A1 Oct. 21, 2010

(51) Int. Cl.
*F02M 37/04* (2006.01)

(52) U.S. Cl. ..... 123/446; 123/497

(58) Field of Classification Search ..... 123/446, 123/447, 357, 457, 497
See application file for complete search history.

(56) References Cited

U.S. PATENT DOCUMENTS 4,206,634 A * 6/1980 Taylor et al. ..... 73/114.41
5,241,933 A * 9/1993 Morikawa ..... 123/198 D
5,499,538 A * 3/1996 Glidewell et al. ..... 73/114.41
5,616,837 A * 4/1997 Leonard et al. ..... 73/114.43
5,699,772 A * 12/1997 Yonekawa et al. ..... 123/497
5,715,797 A * 2/1998 Minagawa et al. ..... 123/497
5,723,780 A * 3/1998 Miwa et al. ..... 73/114.43
5,727,516 A * 3/1998 Augustin et al. ..... 123/198 DB
5,738,063 A 4/1998 Pfuhl et al.
5,816,220 A 10/1998 Stumpp et al.
5,937,826 A * 8/1999 Olson et al. ..... 123/447
5,974,865 A * 11/1999 Dambach ..... 73/49.7
6,024,064 A * 2/2000 Kato et al. ..... 123/179.17
6,032,639 A * 3/2000 Goto et al. ..... 123/295
6,053,147 A * 4/2000 Hemmerlein et al. ..... 123/447
6,076,504 A * 6/2000 Stavnheim et al. ..... 123/447
6,223,731 B1 * 5/2001 Yoshiume et al. ..... 123/497
6,293,251 B1 * 9/2001 Hemmerlein et al. ..... 123/447
6,453,878 B1 * 9/2002 Mazet ..... 123/497
6,474,292 B1 11/2002 Frenz et al.
6,474,306 B2 * 11/2002 Muller et al. ..... 123/479
6,488,012 B1 12/2002 Suffredini et al.
6,497,223 B1 * 12/2002 Tuken et al. ..... 123/497
6,539,921 B1 * 4/2003 Matsumura ..... 123/456
6,609,501 B2 * 8/2003 Doane et al. ..... 123/458
6,697,741 B2 * 2/2004 Yu et al. ..... 702/33
6,792,919 B2 * 9/2004 Kohketsu et al. ..... 123/447
6,871,633 B1 * 3/2005 Date et al. ..... 123/447
6,889,666 B2 * 5/2005 Oono ..... 123/514
6,899,084 B2 * 5/2005 Miyashita ..... 123/446
6,948,480 B2 * 9/2005 Eser et al. ..... 123/495
7,007,676 B1 * 3/2006 Schuricht et al. ..... 123/479
7,086,838 B2 * 8/2006 Thompson et al. ..... 417/45
7,107,968 B2 * 9/2006 Nomura ..... 123/456
7,143,747 B2 * 12/2006 Uchiyama ..... 123/456
7,278,405 B2 * 10/2007 Takahashi ..... 123/514
7,293,548 B2 * 11/2007 Oono ..... 123/446
7,302,938 B2 * 12/2007 Yu et al. ..... 123/514
7,392,793 B2 * 7/2008 Hayakawa ..... 123/479
7,472,690 B2 * 1/2009 Takayanagi et al. ..... 123/446
7,568,468 B2 * 8/2009 Wolber et al. ..... 123/446
7,603,227 B2 * 10/2009 Watanabe et al. ..... 701/113

(Continued)

*Primary Examiner* — Thomas N Moulis

(57) ABSTRACT

A control system includes a fuel pump control module and a diagnostic module. The fuel pump control module controls a fuel pump to provide fuel to a fuel rail. The diagnostic module controls the fuel pump control module to provide a predetermined amount of fuel to the fuel rail, determines an estimated pressure increase within the fuel rail based on the predetermined amount of fuel, and compares an actual pressure increase within the fuel rail to the estimated pressure increase. The fuel pump control module selectively controls the fuel pump based on the comparison.

20 Claims, 4 Drawing Sheets

U.S. PATENT DOCUMENTS

| | | | | |
|---|---|---|---|---|
| 7,650,779 | B2 * | 1/2010 | Puckett et al. | 73/114.41 |
| 7,706,962 | B2 * | 4/2010 | Fushiki et al. | 701/114 |
| 7,784,446 | B2 * | 8/2010 | Rumpf | 123/497 |
| 2004/0002810 | A1 * | 1/2004 | Akuzawa et al. | 701/114 |
| 2007/0251502 | A1 * | 11/2007 | Takayanagi et al. | 123/458 |
| 2008/0306648 | A1 * | 12/2008 | Takahashi | 701/29 |
| 2009/0205413 | A1 * | 8/2009 | Yamauchi et al. | 73/114.41 |

* cited by examiner

FUEL PUMP CONTROL SYSTEM AND METHOD

FIELD

The present disclosure relates to fuel systems and more particularly to fuel pump control systems and methods.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In an engine system, air is drawn into an engine. The air mixes with fuel to form an air-fuel mixture. Fuel is supplied to the engine by a fuel system. For example only, the fuel system may include a fuel tank, a low pressure pump, a high pressure pump, a fuel rail, and fuel injectors. Fuel is stored within the fuel tank. The low pressure pump draws fuel from the fuel tank and provides fuel at a first pressure to the high pressure pump. The high pressure pump provides fuel at a second pressure to the fuel injectors via the fuel rail. The second pressure may be greater than the first pressure.

An engine control module (ECM) receives a rail pressure signal from a rail pressure sensor, which measures the second pressure. The ECM controls the amount and the timing of the fuel injected by the fuel injectors. The ECM also controls the high pressure pump to maintain the second pressure at a predetermined pressure.

SUMMARY

A control system includes a fuel pump control module and a diagnostic module. The fuel pump control module controls a fuel pump to provide fuel to a fuel rail. The diagnostic module controls the fuel pump control module to provide a predetermined amount of fuel to the fuel rail, determines an estimated pressure increase within the fuel rail based on the predetermined amount of fuel, and compares an actual pressure increase within the fuel rail to the estimated pressure increase. The fuel pump control module selectively controls the fuel pump based on the comparison.

A method includes providing a predetermined amount of fuel to a fuel rail, determining an estimated pressure increase within the fuel rail based on the predetermined amount of fuel, comparing an actual pressure increase within the fuel rail to the estimated pressure increase, and selectively controlling a fuel pump based on the comparison.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
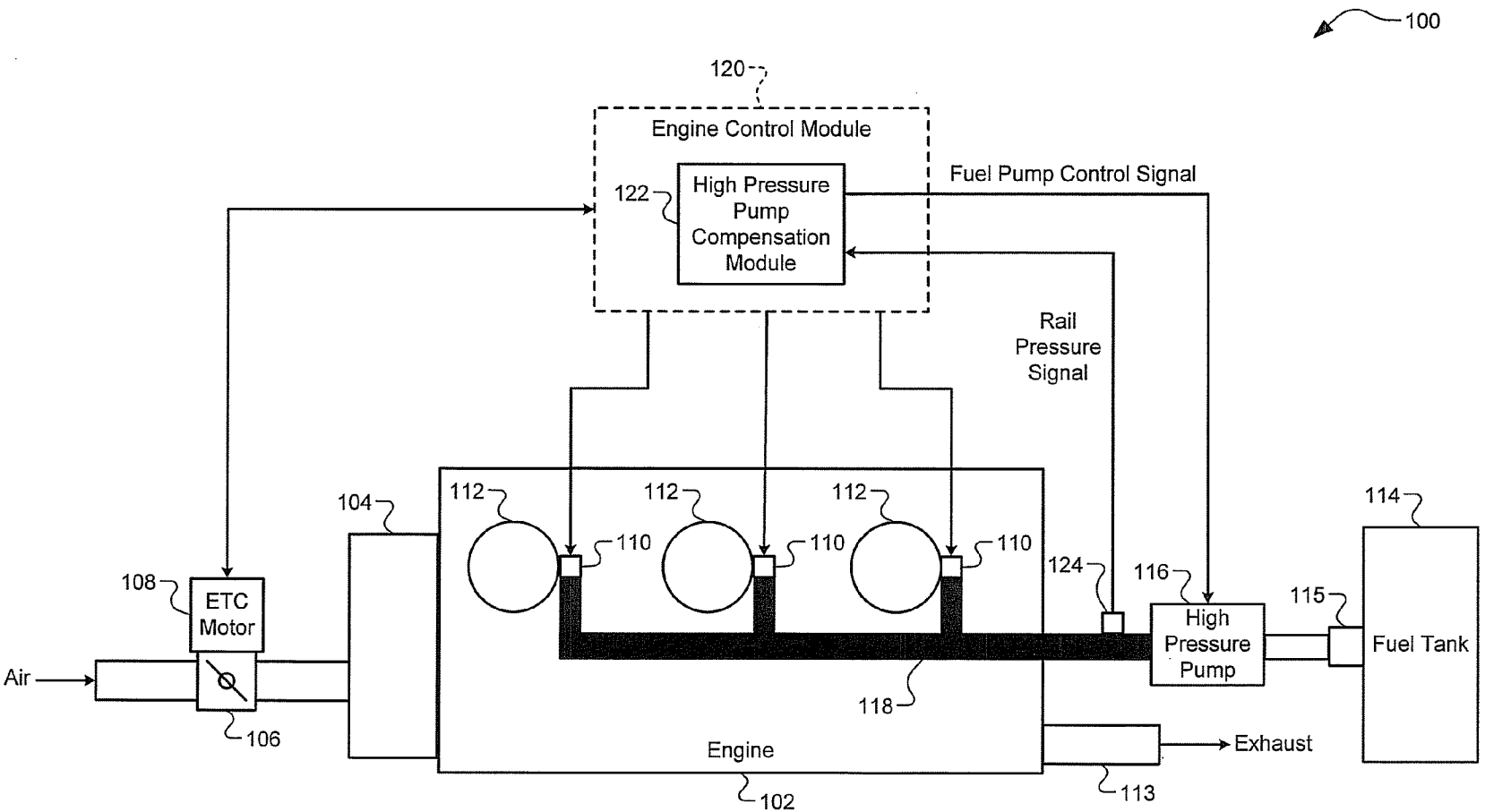
FIG. 1 is a functional block diagram of an exemplary engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A high pressure pump injects pressurized fuel into a fuel rail to achieve a desired pressure within the fuel rail. Fuel injectors connected to the fuel rail inject fuel into cylinders. Over time, the high pressure pump may provide less fuel than is commanded. For example, the high pressure pump may deteriorate over time and/or mechanical problems, such as blockages, may occur. When less fuel is provided to the fuel rail than is expected, the amount of fuel injected into the cylinders may be lower than desired.

In order to measure performance of the high pressure pump, the fuel rail may be converted into a closed system by suspending injection of fuel by the fuel injectors. The high pressure pump can then be instructed to inject a predetermined amount of fuel into the fuel rail. An actual pressure increase within the fuel rail due to the injected fuel may be measured. An estimated pressure increase within the fuel rail due to the injected fuel may be estimated using a mathematical model. A compensation factor may be calculated when the actual pressure increase is less than the estimated pressure increase. The compensation factor may be used to compensate for a deficiency of the high pressure pump.

Referring now to FIG. 1, a functional block diagram of an exemplary engine system 100 according to the principles of the present disclosure is shown. Air is drawn into an engine 102 through an intake manifold 104. A throttle valve 106 is actuated by an electronic throttle control (ETC) motor 108 to vary the volume of air drawn into the engine 102. The air mixes with fuel from one or more fuel injectors 110 to form an air-fuel mixture. The air-fuel mixture is combusted within one or more cylinders 112 of the engine 102. Resulting exhaust gas is expelled from the cylinders 112 to an exhaust system 113.

Fuel is supplied to the engine 102 by a fuel system. For example only, the fuel system may include a fuel tank 114, a low pressure pump 115, a high pressure pump 116, a fuel rail 118, and the fuel injectors 110. Fuel is stored within the fuel tank 114. The low pressure pump 115 draws fuel from the fuel tank 114 and provides fuel to the high pressure pump 116. The high pressure pump 116 provides pressurized fuel to the fuel injectors 110 via the fuel rail 118. The pressure of the fuel exiting the high pressure pump 116 may be greater than the pressure of the fuel exiting the low pressure pump 115. For example only, the pressure of the fuel exiting the high pressure pump 116 may be between 2-26 Megapascal (MPa), while the pressure of the fuel exiting the low pressure pump 115 may be between 0.3-0.6 MPa.

An ECM 120 may include a high pressure pump compensation module (HPPCM) 122 that receives a rail pressure signal from a rail pressure sensor 124. Alternatively, the HPPCM 122 may be located outside of the ECM 120. The rail pressure signal indicates the pressure of the fuel within the fuel rail 118. The HPPCM 122 may control the amount and the timing of the fuel injected by the fuel injectors 110. The rail pressure decreases each time fuel is injected by one or more of the fuel injectors 110. The HPPCM 122 may maintain the rail pressure via the high pressure pump 116.

Figure 2:
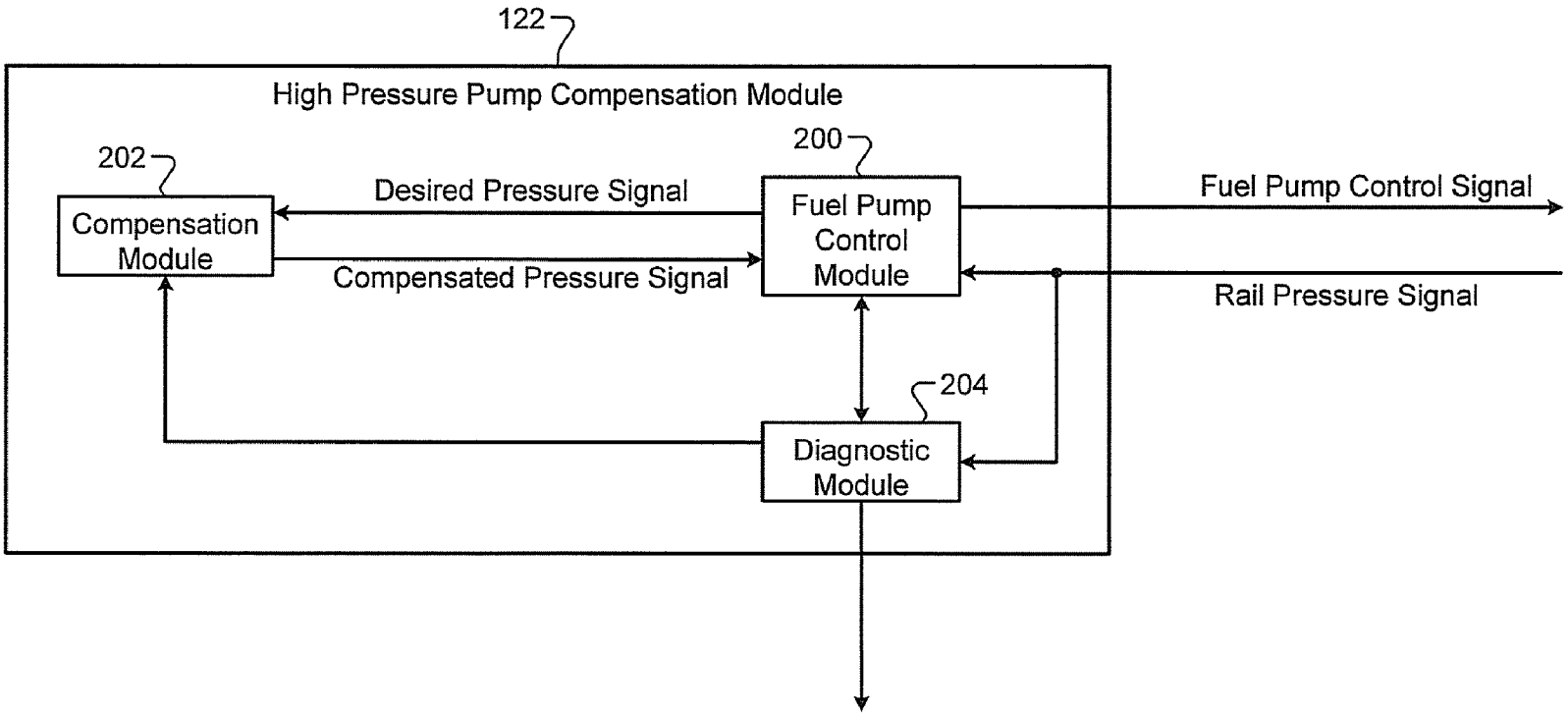
FIG. 2 is a functional block diagram of an exemplary implementation of the high pressure pump compensation module of FIG. 1 according to the principles of the present disclosure.

In FIG. 2, a functional block diagram of an exemplary implementation of the HPPCM 122 of FIG. 1 according to the principles of the present disclosure is shown. A fuel pump control module 200 controls the high pressure pump 116 via a fuel pump control signal. The fuel pump control module 200 receives a compensated pressure signal from a compensation module 202 and controls the high pressure pump 116 based on the compensated pressure signal. The fuel pump control module 200 may receive the rail pressure signal and control the high pressure pump 116 based thereon.

A diagnostic module 204 receives the rail pressure signal. The diagnostic module 204 monitors the rail pressure during testing of the high pressure pump 116. After the diagnostic module 204 receives a start test signal, the diagnostic module 204 determines whether the rail pressure is less than a predetermined threshold. If the rail pressure is less than the predetermined threshold, then testing of the high pressure pump 116 begins. The start test signal is generated when testing may begin. For example only, the diagnostic module 204 may receive the start test signal from the fuel pump control module 200 when fuel injection from the fuel rail 118 is suspended. Fuel injection may be suspended during a coast and/or braking event to improve fuel economy.

When testing of the high pressure pump 116 begins, the diagnostic module 204 transmits a pump test signal to the fuel pump control module 200. Upon receiving the pump test signal, the fuel pump control module 200 controls the high pressure pump 116 to inject a predetermined amount of fuel into the fuel rail 118. After this injection, the diagnostic module 204 monitors an actual rail pressure increase.

The diagnostic module 204 compares the actual rail pressure increase to an estimated rail pressure increase. The estimated rail pressure increase is an estimation of an expected rail pressure increase resulting from injection of the predetermined amount of fuel. If the actual rail pressure increase is less than the estimated rail pressure increase, then the compensation factor may be calculated. If the actual rail pressure increase is greater than or equal to the estimated rail pressure increase, then calculation of the compensation factor may be disabled. Alternatively, if the actual rail pressure increase is greater than or equal to the estimated rail pressure increase, then a compensation factor may be calculated to ensure the desired rail pressure is achieved.

The compensation factor is determined based on a difference between the actual rail pressure increase and the estimated rail pressure increase. As discussed in more detail below, the compensation factor may be implemented to compensate for the difference. For example only, a lookup table or algorithm may be used to determine the compensation factor. The compensation factor is transmitted to the compensation module 202.

The compensation factor may be compared to a threshold. For example, compensation of the high pressure pump 116 may be insufficient to achieve a desired rail pressure in the fuel rail 118 or the high pressure pump 116 may need to be replaced when the compensation factor is greater than or equal to the threshold. The diagnostic module 204 may set a service indicator and/or suspend compensation of the high pressure pump 116 when the calculated compensation factor is greater than or equal to the threshold. For example only, the service indicator may be an On-Board Diagnostics II diagnostic trouble code, which may lead to illumination of a malfunction indicator light.

The compensation module 202 may receive a desired pressure signal from the fuel pump control module 200. The desired pressure signal indicates the desired rail pressure for the fuel rail 118. The fuel pump control module 200 controls the high pressure pump 116 so that the desired rail pressure is maintained. However, if the actual rail pressure increase is less than the estimated rail pressure increase, then the desired rail pressure may not be achieved when controlling the high pressure pump 116. The compensation module 202 uses the compensation factor to adjust the desired pressure signal to generate a compensated pressure signal. However, the compensation module 202 may suspend generating the compensated pressure signal when the actual rail pressure increase is greater than or equal to the estimated rail pressure increase.

The implementation of the compensation factor allows for a better realization of the desired rail pressure because the actual rail pressure increase may be closer to the estimated rail pressure increase. The actual rail pressure increase may be closer to the estimated rail pressure increase when the diagnostic module 204 determines the actual rail pressure increase is less than the estimated rail pressure increase and the compensation module 202 uses the compensation factor to adjust the desired pressure signal. The compensation module 202 transmits the compensated pressure signal to the fuel pump control module 200. Then, the fuel pump control module 200 uses the compensated pressure signal to control the high pressure pump 116 to achieve the desired pressure within the fuel rail 118.

Figure 3:
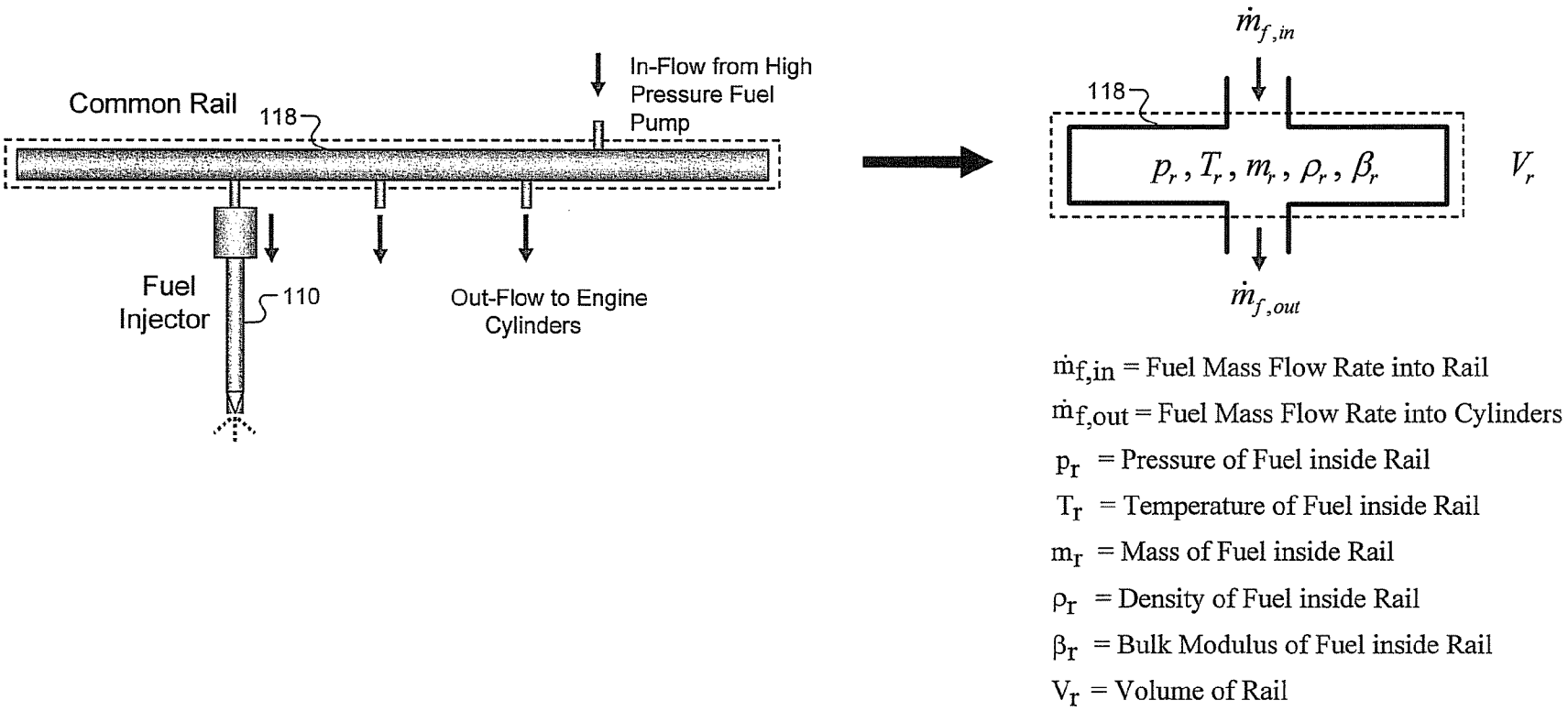
FIG. 3 is a functional block diagram of an exemplary model of the fuel rail of FIG. 1 according to the principles of the present disclosure.

In FIG. 3, a functional block diagram of an exemplary model of the fuel rail 118 according to the principles of the present disclosure is shown. The exemplary model of the fuel rail 118 and variable definitions in FIG. 4 may be used along with model assumptions to determine the compensation factor. The model assumptions may include zero-dimensional fuel flow, compressible fuel flow, fuel density that is a function of temperature and bulk modulus, and fuel bulk modulus that is a function of pressure alone.

A rail fuel mass increase rate $$\left(\frac{dm_r}{dt}\right)$$

may be determined based on the principle of mass conservation using the following equation, where $\dot{m}_{f,in}$ and $\dot{m}_{f,out}$ are the fuel mass flow rates in and out of the fuel rail 118, respectively:

$$\frac{dm_r}{dt} = \dot{m}_{f,in} - \dot{m}_{f,out} \tag{1}$$

A fuel volumetric flow rate ($\dot{V}_{f,in}$) may be determined when fuel injection is suspended (i.e., $\dot{m}_{f,out}=0$) using the following equation, where $\rho_r$ is a fuel density:

$$\frac{dm_r}{dt} = \dot{m}_{f,in} \Rightarrow \dot{V}_{f,in} = \frac{1}{\rho_r}\frac{dm_r}{dt} \tag{2}$$

A rail fuel mass increase ($dm_r$) may be defined in terms of a fuel bulk modulus ($\beta_r$) using the following equation, where $dp_r$ is the rail fuel pressure increase, $m_r$ is the rail fuel mass, and $V_r$ is the fuel rail volume:

$$\begin{aligned}\beta_r &= \frac{dp_r}{(d\rho_r/\rho_r)} \\ &= \rho_r\frac{dp_r}{d\rho_r} \\ &= \frac{m_r}{V_r}\frac{dp_r}{(dm_r/V_r)} \\ &= m_r\frac{dp_r}{dm_r} \Rightarrow dm_r \\ &= m_r\frac{dp_r}{\beta_r}\end{aligned} \tag{3}$$

Inserting the equation for rail mass increase from Equation 3 into Equation 2 yields the following equation:

$$\dot{V}_{f,in} = \frac{V_r}{\beta_r}\frac{dp_r}{dt} \tag{4}$$

Inserting the equation for fuel volumetric flow rate from Equation 2 into Equation 4 yields the following equation:

$$\frac{1}{\rho_r}\frac{dm_r}{dt} = \frac{V_r}{\beta_r}\frac{dp_r}{dt} \Rightarrow \Delta p_r = \frac{\beta_r}{\rho_r V_r}\Delta m_r \tag{5}$$

Equation 5 may be used to determine an estimated rail pressure increase ($\Delta p_r$) based on the predetermined amount of fuel injected into the fuel rail 118 ($\Delta m_r$) and predetermined parameters. The predetermined parameters include the fuel bulk modulus, the fuel density, and the fuel rail volume.

Figure 4:
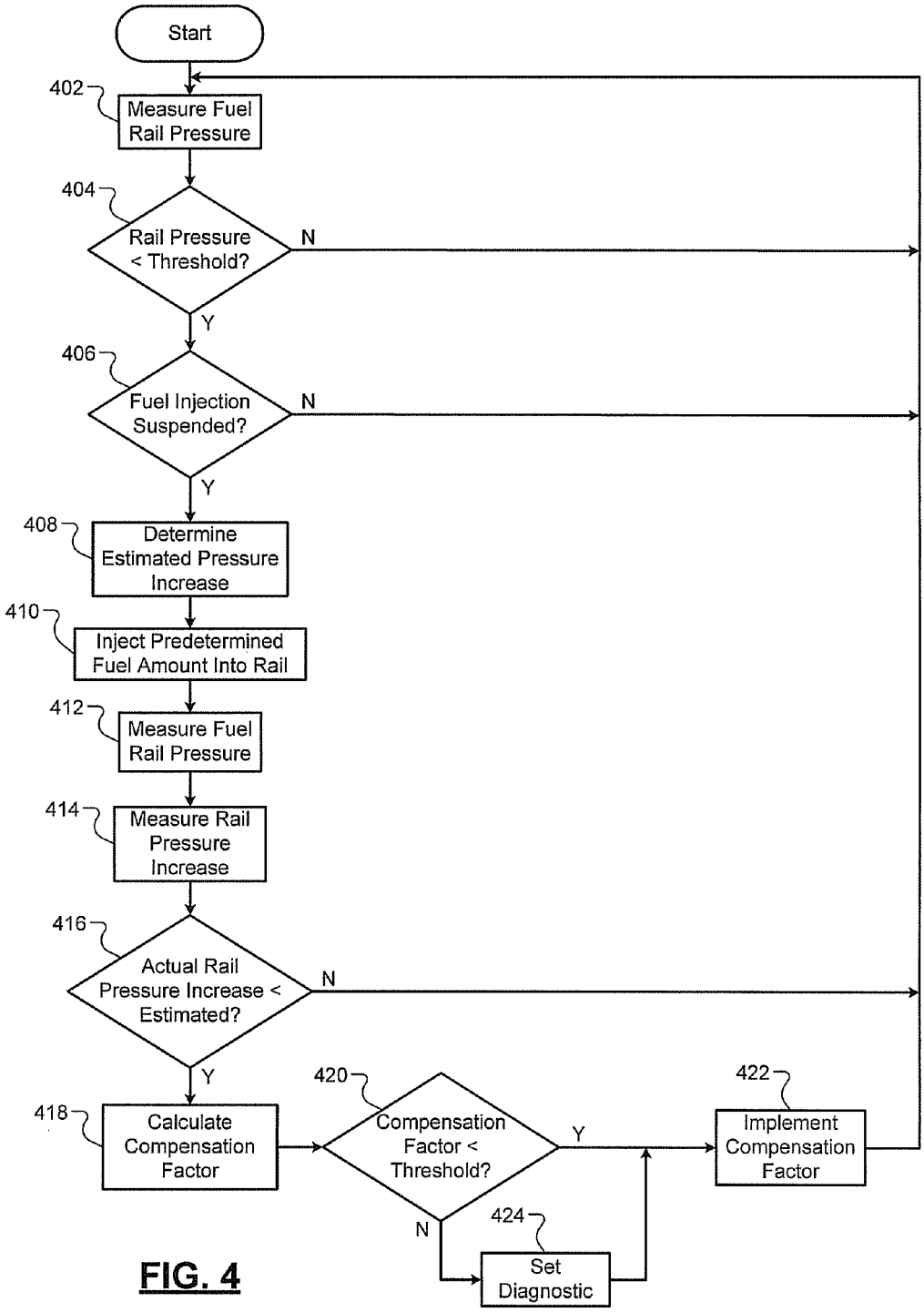
FIG. 4 is a flowchart that depicts exemplary steps performed in controlling the high pressure pump according to the principles of the present disclosure.

In FIG. 4, a flowchart depicts exemplary steps performed in determining high pressure pump compensation according to the principles of the present disclosure. In step 402, control measures fuel rail pressure. In step 404, control compares the measured fuel rail pressure to a threshold. If the measured fuel rail pressure is greater than or equal to the threshold, then control returns to step 402; otherwise, control transfers to step 406.

In step 406, control checks for proper test conditions (i.e., fuel injection suspended). If the proper test conditions are met, then control transfers to step 408; otherwise, control returns to step 402. In step 408, control determines an estimated pressure increase. In step 410, control injects a predetermined amount of fuel into the fuel rail 118. In step 412, control measures fuel rail pressure. In step 414, control determines an actual rail pressure increase.

In step 416, control compares the actual rail pressure increase to the estimated pressure increase. If the actual rail pressure increase is greater than or equal to the estimated pressure increase, then control returns to step 402; otherwise, control transfers to step 418. In step 418, control calculates a compensation factor for the fuel pump. In step 420, control determines whether the compensation factor is less than a threshold. If the compensation factor is not less than a threshold, then control transfers to step 424; otherwise, control transfers to step 422. In step 424, control sets a service indicator. In step 422, control may use the compensation factor to adjust the desired pressure signal, thereby brining the actual rail pressure increase closer to the estimated rail pressure increase. Alternatively, control may not use the compensation factor (e.g., set the compensation factor equal to 1) when the compensation factor is not less than a threshold. Control returns to step 402.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system comprising:

a fuel pump control module that controls a fuel pump to provide fuel to a fuel rail;

a fuel injection control module that selectively suspends fuel injection from the fuel rail based on vehicle operating conditions; and a diagnostic module that controls the fuel pump control module to provide a predetermined amount of fuel to the fuel rail when fuel injection from the fuel rail is suspended based on the vehicle operating conditions, that determines an estimated pressure increase within the fuel rail based on the predetermined amount of fuel, that compares an actual pressure increase within the fuel rail to the estimated pressure increase, and that selectively diagnoses a fault in the fuel pump based on the comparison.

2. The control system of claim 1 wherein the diagnostic module determines the estimated pressure increase within the fuel rail based on a mathematical model.

3. The control system of claim 2 wherein the mathematical model includes an expression that relates the estimated pressure increase to a fuel bulk modulus, a fuel density, a fuel rail volume, and the predetermined amount of fuel.

4. The control system of claim 1 wherein the diagnostic module calculates a compensation factor based on the comparison.

5. The control system of claim 4 wherein the diagnostic module calculates the compensation factor based on a difference between the estimated pressure increase and the actual pressure increase.

6. The control system of claim 4 wherein the diagnostic module sets a service indicator when the compensation factor is greater than or equal to a predetermined threshold.

7. The control system of claim 4 further comprising a compensation module that selectively generates a compensated pressure signal based on the compensation factor and a desired pressure, and wherein the fuel pump control module selectively controls the fuel pump based on the compensated pressure signal.

8. The control system of claim 7 wherein the fuel pump control module suspends controlling based on the compensated pressure signal and controls based on the desired pressure when the actual pressure increase is greater than or equal to the estimated pressure increase.

9. A method comprising:

selectively suspending fuel injection from a fuel rail based on vehicle operating conditions;

controlling a fuel pump to provide a predetermined amount of fuel to the fuel rail when fuel injection from the fuel rail is suspended based on the vehicle operating conditions;

determining an estimated pressure increase within the fuel rail based on the predetermined amount of fuel;

comparing an actual pressure increase within the fuel rail to the estimated pressure increase; and selectively diagnosing a fault in the fuel pump based on the comparison.

10. The method of claim 9 further comprising determining the estimated pressure increase within the fuel rail based on a mathematical model.

11. The method of claim 10 wherein the mathematical model includes an expression that relates the estimated pressure increase to a fuel bulk modulus, a fuel density, a fuel rail volume, and the predetermined amount of fuel.

12. The method of claim 9 further comprising calculating a compensation factor based on the comparison.

13. The method of claim 12 further comprising calculating the compensation factor based on a difference between the estimated pressure increase and the actual pressure increase.

14. The method of claim 12 further comprising setting a service indicator when the compensation factor is greater than or equal to a predetermined threshold.

15. The method of claim 12 further comprising:

selectively generating a compensated pressure signal based on the compensation factor and a desired pressure; and selectively controlling the fuel pump based on the compensated pressure signal.

16. The method of claim 15 further comprising, when the actual pressure increase is greater than or equal to the estimated pressure increase, controlling based on the desired pressure and suspending the controlling based on the compensated pressure signal.

17. The control system of claim 1, wherein the fuel pump control module selectively controls the fuel pump based on the comparison.

18. The method of claim 9, further comprising selectively controlling the fuel pump based on the comparison.

19. The control system of claim 1, wherein the fuel injection control module suspends fuel injection from the fuel rail during at least one of a coasting event and a braking event.

20. The method of claim 9, further comprising suspending fuel injection from the fuel rail during at least one of a coasting event and a braking event.

* * * * *